United States Patent [19]

Taylor

[11] 4,053,255

[45] Oct. 11, 1977

[54] SELF-ADJUSTING SPACER FOR CENTRIFUGAL PUMPS

[76] Inventor: Carl A. Taylor, 1503 Glastonberry Road, Maitland, Fla. 32751

[21] Appl. No.: 724,398

[22] Filed: Sept. 17, 1976

[51] Int. Cl.[2] ..... F03B 11/02; F03B 11/04

[52] U.S. Cl. ..... 415/127; 415/128; 254/104

[58] Field of Search ..... 415/104, 107, 108, 126, 415/127, 128; 418/203

[56] References Cited

U.S. PATENT DOCUMENTS

| | | | |
|---|---|---|---|
| 2,777,665 | 1/1957 | Martinson | 415/134 |
| 3,746,461 | 7/1973 | Yokota et al. | 415/104 |

*Primary Examiner*—William L. Freeh
*Assistant Examiner*—R. E. Gluck
*Attorney, Agent, or Firm*—Duckworth, Hobby & Allen

[57] ABSTRACT

This invention relates to a self-adjusting spacer mechanism for being interposed in a centrifugal pump between a volute and a barrel end surface for regulating the spacing therebetween. The spacer includes a first inclined surface and an outer surface coupled with an inside surface of the barrel cover. A second sliding plate has an outer surface coupled with an end surface of the volute and a second inclined surface generally parallel to and in sliding communication with the first inclined surface of the first sliding plate. A bias spring is coupled between the first and second sliding plate for advancing the sliding communication therebetween in a preferred direction for increasing the separation between the outside surfaces responsive to a separation between the volute and the barrel end surface.

In a first preferred embodiment of the present invention a triggering device is coupled between the first sliding plate and the second sliding plate for restricting the motion therebetween until the triggering device is actuated. Also, a unidirectional clutch is coupled between the first and second sliding plates for limiting the motion therebetween to the preferred direction.

14 Claims, 6 Drawing Figures

SELF-ADJUSTING SPACER FOR CENTRIFUGAL PUMPS

BACKGROUND OF THE INVENTION

1. Field of the Invention

This invention relates to centrifugal pumps, and the like, of the type having a volute axially movable within a barrel, and in particular to an improved spacer for regulating the separation between the volute and an inside surface of the end barrel cover.

2. Description of the Prior Art

One of the most difficult design problems in building a reliable centrifugal pump involves obtaining a proper and long-lived seal between the high pressure and low pressure sections of the pump. In applications requiring the pump to handle water under high pressure and high temperature conditions, these design objectives are even more critical since downtime of the centrifugal pump often means large repair expenses and causes downtime for even more expensive and more critical machines dependent on the operation of a centrifugal pump.

Centrifugal pumps are generally constructed with an outside barrel having a cylindrical cavity for receiving therein a generally cylindrical volute. The volute includes a plurality of cavities for receiving therein the rotary blades which are coupled to an impeller shaft which communicates through the volute and barrel. The high pressure and low pressure sections of the centrifugal pump are separated by a specially designed annular seal. As the centrifugal pump is operated, the high pressure acting upon one end of the volute compresses the seal. However, when the output of the centrifugal pump is reduced, the reduction in output pressure will allow a reverse direction movement in the volute as it presses against the annular seal. This movement eventually allows a leakage path between the high pressure and low pressure sections of the centrifugal pump which allows leaking water to erode away sections of the volute and barrel adjacent to the annular seal. This causes a reduction in output pressure from the pump and can lead to serious reliability problems.

Various methods have been utilized for restricting this reverse motion of the volute, but none have been acceptable in all respects. McHugh in U.S. Pat. No. 2,017,544 discloses the flexible seal which is provided between the shell casing of the pump and the starter parts thereof. This flexible seal uses axially aligned springs which are utilized to compress the volute against the seal. Other devices relating to centrifugal pumps or compressors are disclosed by Davis in U.S. Pat. No. 3,325,087, Johnson in U.S. Pat. No. 2,867,460 and Hall in U.S. Pat. No. 2,247,125.

Martinson, in U.S. Pat. No. 2,777,665, dicloses an improved method for supporting a tubine casing which will allow the turbine casing to expand and contract relative to the pedestal without changing the relative position between the casing and the shaft extending therethrough and into the bearing support mounting in the pedestal.

SUMMARY OF THE INVENTION

This invention relates to an improved self-adjusting spacer for use in a centrifugal pump of the type having a volute axially movable within a barrel. The self-adjusting spacer includes a first sliding plate having an outer surface coupled with an inside surface of the barrel cover and further including a first inclined surface thereon. A second sliding plate includes an outer surface coupled with an end surface of the volute. The second sliding plate also includes a second inclined surface thereon generally parallel to and in sliding communication with the first inclined surface of the first sliding plate. Bias means are coupled between the first and second sliding plates for advancing the sliding communication therebetween in a preferred direction, thereby increasing the separation between the outside surfaces of the first and second sliding plates to accommodate the increased separation between the inside surface of the barrel cover and the end surface of the volute.

Clutch means are coupled between the first and second sliding plates for preventing the motion therebetween in a direction opposite the preferred direction. Enabling means are coupled between the first and second sliding plates for restricting the motion therebetween in the preferred direction when in a guard mode and permitting the sliding communication therebetween when in a free mode. The enabling means is actuated by a trigger.

BRIEF DESCRIPTION OF THE DRAWINGS

Other objects, features and advantages of the present invention will be apparent from a study of the written description and the drawings in which.

DETAILED DESCRIPTION OF THE PREFERRED EMBODIMENT

Figure 1:
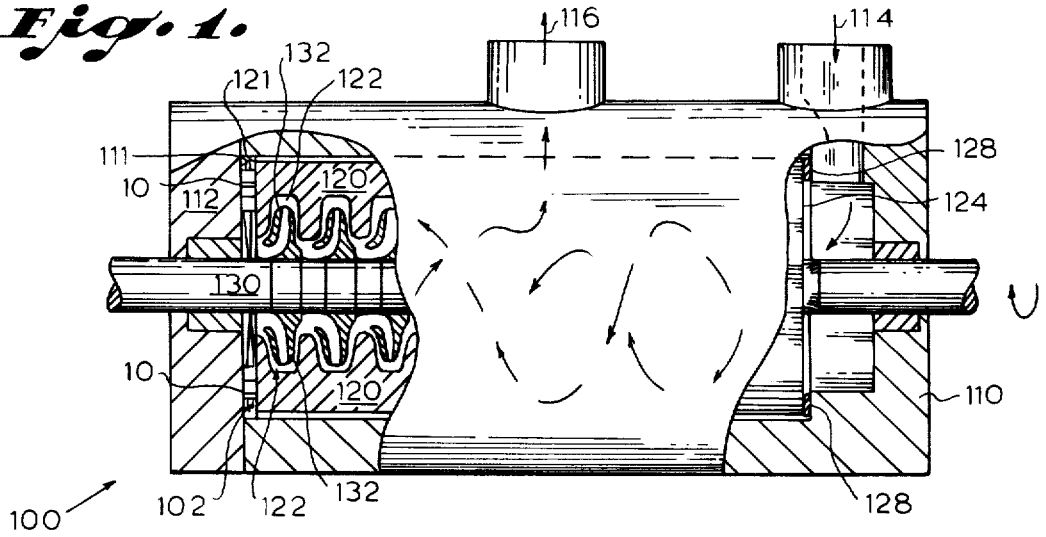
FIG. 1 illustrates a frontal cross-section elevation of a centrifical pump adapted to include the self-adjusting spacer in accordance with the present invention.

A centrifugal high pressure pump is illustrated generally as 100 in FIG. 1. The pump includes a barrel casing 110, having a generally cylindrical form, and a cylindrical volute cavity 102 located generally coaxially therein. A cylindrical volute 120 is inserted within the volute cavity 102. The volute 120 includes a plurality of radial cavities 122 for receiving therein the radial impellers 132, which in turn are coupled to an impeller shaft 130. The impellers 132 which are rotated by the impeller shaft 130 accept intake water through an intake port 114 and centrifugally increase the pressure of the fluid as it passes from stage to stage within the centrifugal pump 100. A typical pump will receive the hot water input at the intake port 114 at a pressure of approximately 400–500 psi and will raise the pressure of water at an exit or discharge port 116 to a pressure of approximately 2,700 psi. This pressure differential of 2,300 psi (2,700 psi minus 400 psi) is exerted upon a first end 121 of the volute 120 and also against an inside surface 111 of a barrel cover 112. This pressure differential is exerted by a second end of the volute 124 against an annular sealing gasket 128 which is compressed against an end of the barrel casing 110.

As the motor driving the impeller shaft 130 causes the centrifugal pump 100 to ingest and expell the water under high pressure, the second end 124 of the volute 120 compresses the annular sealing gasket 128 against the end of the barrel casing 112 within the volute cavity 102. However, when the power to the impeller shaft 130 is decreased, the pressure differential on the first end 121 of the volute 120 will also be decreased, thereby allowing the volute 120 to move in a direction opposite from the original motion and away from the annular sealing gasket 128. While the resiliency of the annular sealing gasket 128 will absorb some of the spacing created between the second end 124 of the volute 120 and the barrel casing 110, it has generally been discovered that the resiliency of the annular sealing gasket 128 is not sufficient to prevent the passage of high pressure water around the annular sealing gasket 128 and into the intake port 114. As this leakage continues, corrosive effects will wear away sections of the volute 120 and the barrel casing 110 adjacent the annular sealing gasket 128 to such an extent that even after the pressure created by the pump 100 is increased to the full rated value, the high pressure water will blow-by the annular sealing gasket 128 through eroded channels and gasket spacings adjacent to the annular sealing gasket 128. This problem is exacerbated by continued cycling of the centrifugal pump 100 between maximum pressure and reduced pressure, because the resiliency of the annular sealing gasket 128 rapidly decreases with age and repeated compressions. The erosion channels in the volute 120 and the barrel casing 110 will rapidly increase in size as the flow of high pressure water increases from the discharge side to the intake side of the centrifugal pump. Eventually, the entire pump must be disassembled by removing the volute 120 from within the volute cavity 102 of the barrel casing 110. The eroded sections of the barrel casing 110 and the volute 120 must be remanufactured by depositing additional material within the erosion channels and then machining the pieces to cooperate within the original machine tolerances. This operation not only requires expensive and extensive work upon the centrifugal pump 100, but also requires the boiler or other apparatus receiving the high pressure water from the discharge port 116 to also be shut down for the duration of the repairs. It is not unusual for repairs of this type to take two or three weeks of downtime, the cost of which can be very large.

The present invention relates to a self-adjusting spacer for being coupled between the inside surface 111 of the barrel cover 112 and the first end surface 121 of the volute 120. This spacer will expand as the pressure created by the pump 100 moves the volute 120 into further compression with the annular sealing gasket 128, but the spacer will not allow the volute 120 to move in the opposite direction as the pressure produced by the centrifugal pump 100 is reduced. Thus a continuous pressure will be induced upon the annular sealing gasket 128, thereby greatly increasing the life expectancy of the centrifugal pump 100. Since the spacers must be positioned prior to the coupling of the barrel cover 112 to the barrel casing 110, it is also necessary to include a triggering or enabling device on the spacer for restraining the action of the spacer until after the barrel cover 112 has been securely coupled to the barrel casing 110.

Figure 2:
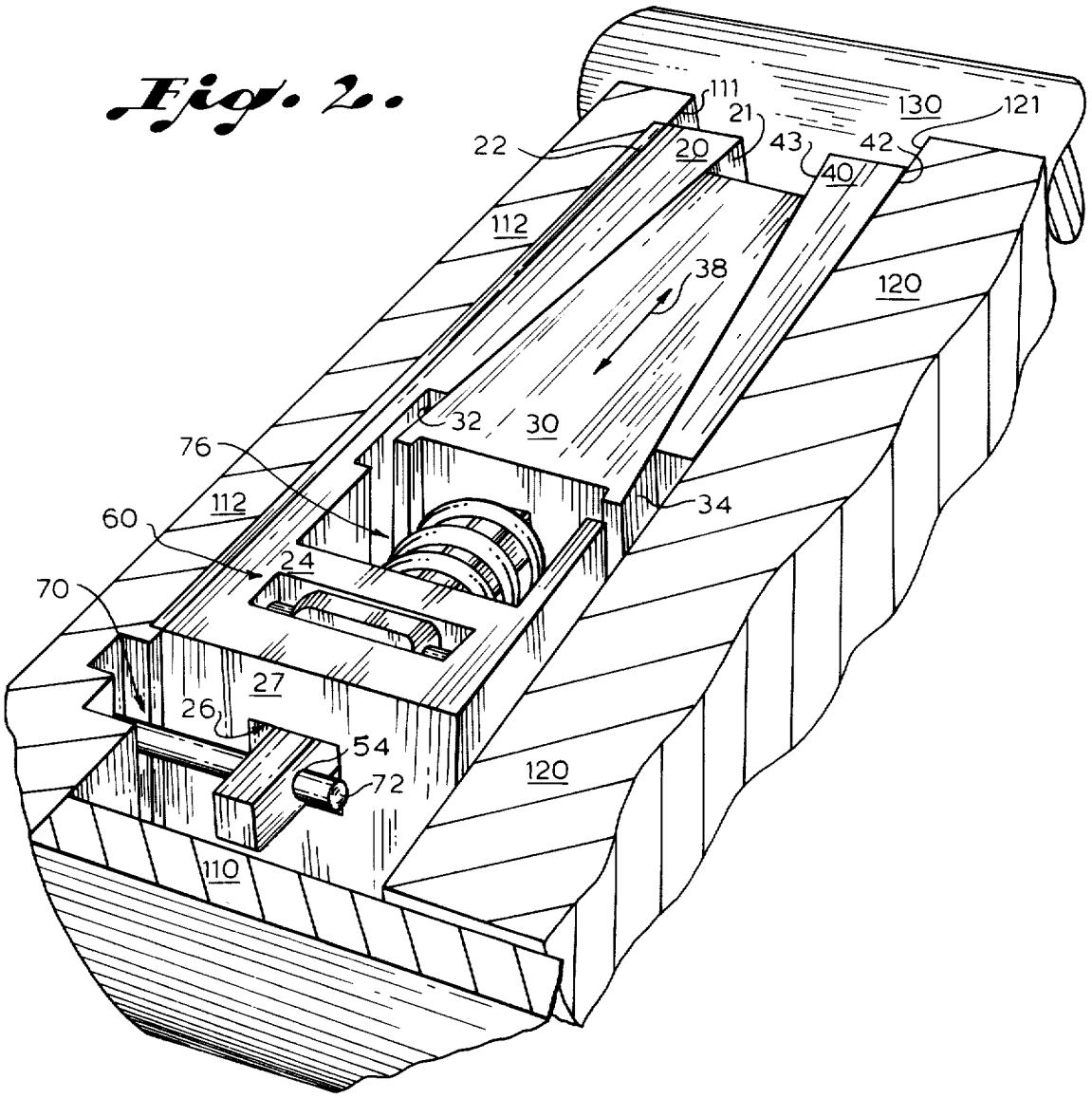
FIG. 2 illustrates a top perspective view of a self-adjusting spacer in accordance with the present invention.

With specific reference to FIG. 2, a self-adjusting spacer in accordance with the present invention is shown generally as 10. The spacer 10 includes a first sliding plate 20 having an outer surface 22 coupled to the inside surface 111 of the barrel cover 112. The first sliding plate 20 also includes a first inclined surface 21 which forms a small acute angle with respect to the outer surface 22. The self-adjusting spacer 10 also includes a second sliding plate 30 having a second inclined surface 32 which is generally parallel to and in planer sliding communication with the first inclined surface 21 of the first sliding plate 20. The second sliding plate 30 further includes a fourth inclined surface 34 which, together with the second inclined surface 32, forms a wedge. The second inclined surface 32 and the fourth inclined surface 34 generally form equal angles with respect to a center line of the second sliding plate 30 (or wedge) is moved longitudinally along the center line 38.

A third sliding plate 40 includes an outer surface 42 which is coupled to the first end surface 121 of the volute 120. The third sliding plate 40 also includes a third inclined surface 43 for slidably coupling with the fourth inclined surface 34 of the second sliding plate 30. In a first preferred embodiment of the present invention the outer surface 42 of the third sliding plate 40 is generally planar for coupling in parallel with the generally planar first end surface 121 of the volute 120. Since the first end surface 121 of the volute 120 is generally machined to be parallel with the inside surface 111 of the barrel cover 112, the included angles defining the first inclined surface 21, the second inclined surface 32, the third inclined surface 43 and the fourth inclined surface 34 are generally symmetrical so that any movement of the second sliding plate 30 along the center line 38 will cause a corresponding lateral movement in a direction perpendicular to the center line 38 of the first sliding plate 20 and the third sliding plate 40. This longitudinal movement of the second sliding plate 30 along the center line 38 may be described as in a preferred direction when it causes an increase in the separation between the first sliding plate 20 and the third sliding plate 40. The first inclined surface 21, the second inclined surface 32, the third inclined surface 43 and the fourth inclined surface 34 are manufactured to provide a minimum of sliding resistance in the preferred direction along the center line 38, while providing a maximum resistance to motion in a direction opposite the preferred direction along the center line 38.

Figure 3:
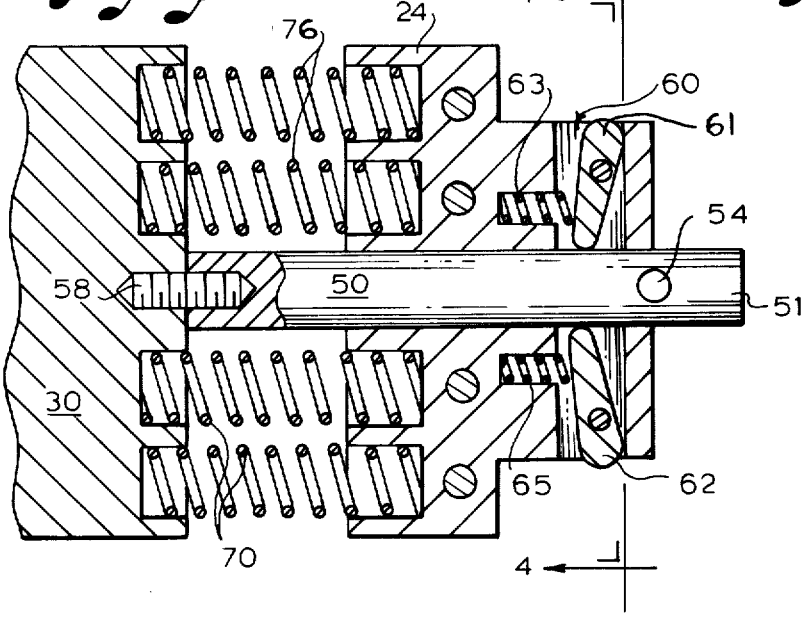
FIG. 3 illustrates a partial side cross-section elevation of the self-adjusting spacer.
Figure 4:
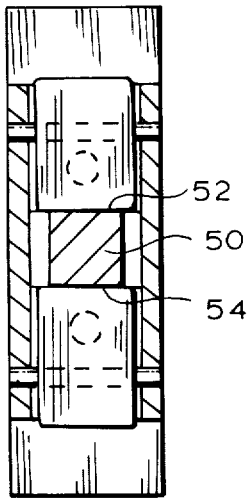
FIG. 4 illustrates an end view of the self-adjusting spacer.

As illustrated in FIGS. 2 and 3, a guide shaft 50 is coupled by a threaded stud to the central portion of the second sliding plate 30, generally along the center line 38. A first distended end 51 of the guide shaft 50 extends through a guide aperture 26 in a base section 24 perpendicularly coupled to the first sliding plate 20 at an end thereof opposite the first inclined surface 21. The guide shaft 50 has a generally square cross-section as illustrated in FIG. 4, thereby defining a top planar surface 52 and a bottom planar surface 54 thereon. The guide shaft 50 restricts the vertical motion of the second sliding plate 30 as it moves along the center line 38 in the preferred direction.

The guide shaft 50 is engaged by a unidirectional or sprage clutch, shown generally as 60 in FIGS. 2 and 3. The clutch 60 comprises a first cam 61 and a second cam 62 located on opposite sides of the guide shaft 50 and each having an axis of rotation oriented generally perpendicular to the center line 38 of the second sliding plate 30. The longitudinal length of the first and second cams, 61 and 62, together with the top to bottom dimension of the guide shaft 50 is generally greater than the spacing between the rotational axes of the cams 61 and 62. Therefore, the first and second cams 61 and 62 will slide freely as the guide shaft 50 and the second sliding plate 30 are extended in the preferred direction, but the sliding friction between the cam 61 and 62 and the top and bottom surfaces 52 and 54 of the guide shaft 50 will cause a reverse rotation of the first and second cams 61 and 62, thereby preventing the longitudinal motion of the guide shaft 50 and the second sliding plate 30 are extended in the preferred direction, but the sliding friction between the cam 61 and 62 and the top and bottom surfaces 52 and 54 of the guide shaft 50 will cause a reverse rotation of the first and second cams 61 and 62, thereby preventing the longitudinal motion of the guide shaft 50 in a direction opposite the preferred direction. A first bias spring 63 is coupled to the first cam 61 and a second bias spring 65 is coupled to the second cam 62 for biasing the respective cams into close communication with the respective surfaces of the guide shaft 50 for preventing any backlash in movement of the guide shaft 50 in a direction opposite the preferred direction.

As illustrated in FIG. 3, a plurality of springs are coupled between the planar end of the second sliding plate 30 and the base section 24 of the first sliding plate 20. These springs 76 are in compression between the two surfaces for providing a bias force against the second sliding plate 30 in the preferred direction along the center line 38 thereof. A preferred embodiment of the springs shown generally as 76 in FIG. 2 as comprising a singular compression spring coupled coaxially about the guide shaft 50 between the second sliding plate 30 and the base section 24.

Figure 5:
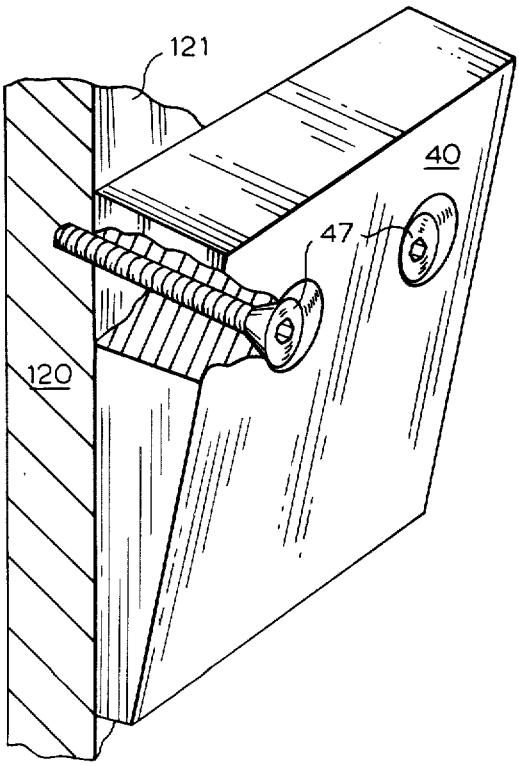
FIG. 5 illustrates a perspective view of a first preferred embodiment of one of the sliding plates.

FIG. 5 illustrates a preferred method for coupling the third sliding plate 40 to the first end surface 121 of the volute 120. The threaded machine screws 47 are coupled through bores in the third sliding plate 40 and have their head sections recessed within the third sliding plate 40. The first sliding plate 20 together with the base section 24 thereof may be coupled in a similar manner to the inside surface 111 of the barrel cover 112. In this manner the third sliding plate 40 will be completely separate from the second sliding plate 30 and the first sliding plate 20 and will be removed together with the barrel cover 112 as the centrifugal pump 100 is disassembled. On the other hand, the third sliding plate 40 will remain attached to the first end surface 121 of the volute 120. In general, the machine tolerances inherent in the design of the centrifugal pump 100 will not require that an elaborate guide system be utilized for positioning and aligning the sliding inclined surfaces of the self-adjusting spacer 10.

Figure 6:
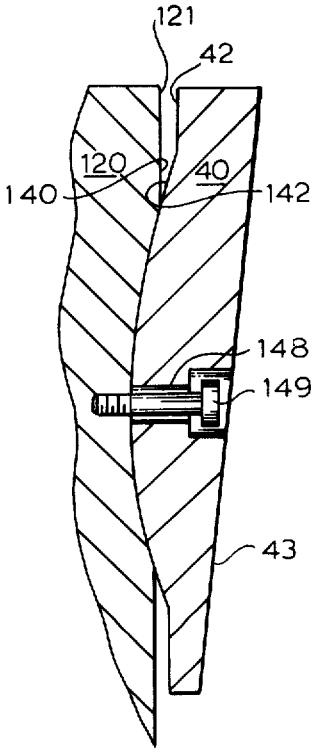
FIG. 6 illustrates a second preferred embodiment of one of the sliding plates.

However, if it is determined that these tolerances are not sufficiently accurate, such as in older machines, or if some type of differential motion between the volute 120 and the barrel cover 112 is desired, a variable position method may be utilized as illustrated in FIG. 6 for aligning the third sliding plate 40 with the fourth inclined surface 34 of the second sliding plate 30. As illustrated in FIG. 6, a concave recess 140 is formed within the first end section 121 of the volute 120 for receiving therein a convex protrusion 142 on the outer surface 42 of the third sliding plate 40. The third sliding plate 40 is secured to the first end 121 of the volute 120 by the flathead screw which communicates through a bore aperture 148 in the third sliding plate 40 for coupling by a plurality of threads into the volute 120. The bore 148 has a diameter slightly larger than the diameter of the flathead portion of the screw without communicating therewith. In this manner the flathead screw 149 merely acts as a retainer without determining the position or orientation of the third sliding plate 40. The concave recess 140 and the convex protrusion 142 communicating therewith are generally preferred to have a longitudinal dimension generally equal to the length of the third sliding plate 40, but in certain circumstances a reduced longitudinal dimension may also be satisfactory. The interaction and coupling between the concave recess 140 and the convex protrusion 142 will allow the third inclined surface 43 thereon to align itself parallel to and in sliding communication with the fourth inclined surface 34 of the second sliding plate 30 even if the first end section 121 of the volute 120 is not exactly parallel with the inside surface 111 of the barrel cover 112.

It is also possible to construct the self-adjusting spacer 10 by fusing the second sliding plate 30 to the third sliding plate 40 along the fourth inclined surface 34 and the third inclined surface 43. Of course, this will assume that the third sliding plate 40 is no longer fixedly attached to the first end 121 of the volute 120. With this type of construction the first inclined surface 21 will slidably communicate with the second inclined surface 32 for determining the separation between the inside surface 111 of the barrel cover 112 and the first end 121 of the volute 120. This will require the outer surface 42 of the third sliding plate 40 to slidably communicate in a parallel fashion along the first end surface 121 of the volute 120. While this design is more mechanical straightforward than the first preferred embodiment of the present invention, it requires the second sliding plate 30 to move twice as far along the center line 38 in the preferred direction, since there is only one inclined coupling communication, that is the sliding interaction between the first inclined surface 21 and the second inclined surface 32. The sliding communication between the outer surface 42 of the third sliding plate 40 and the first end surface 121 of the volute 120 provides no increased separation between the parallel opposing surfaces of the barrel cover 112 and the volute 120.

Since the motion of the second sliding plate 30 must be restrained until the entire self-adjusting spacer 10 and pump 100 are assembled by attaching the barrel cover 112 to the barrel casing 110, an enabling means or trigger means, shown generally at 70 in FIG. 2, it included. The enabling means 70 comprises a shaft 72 coupled through an aperture 54 in the first end 51 of the guide shaft 50, with the shaft generally communicating with an end surface 27 of the base 24 for restricting the longitudinal movement of the guide shaft 50 along the center line 38 in the preferred direction. The shaft 72, or another coupling element such as a chain or line, extends through an aperture within the barrel cover 112 for enabling the shaft 72 to be withdrawn from within the aperture 54, thereby allowing the compression force exerted by the spring biasing elements 70 and 76 to force the second sliding plate 30 between the first sliding plate 20 and the third sliding plate 40. As the wedge or second sliding plate 30 moves in the preferred direction, the guide shaft 50 must move toward the volute as illustrated in FIGS. 2 and 4 since the center line of the second sliding plate 30 will be spaced further from the inside surface 111 of the barrel cover 112 as the second inclined surface 32 slidably communicates along the first inclined surface 27. The width of the guide aperture 26 is such that this movement is allowed for without disrupting the functioning of the clutch 60.

The first sliding plate 20, the second sliding plate 30 and the third sliding plate 40 may all be constructed of a high strength noncorrosive machine grade steel such as stainless with an overlay of stelite. The other ancillary parts may be constructed of similarly suitable materials. Furthermore, the inclined surfaces 21, 32, 34 and 43 may be coated or impregnated with a lubricant to reduce the sliding friction therebetween.

The operation of the first preferred embodiment of the self-adjusting spacer 10 will now be described with reference to the figures. First, the third sliding plate 40 is attached to the first end surface 121 of the volute 120. Second, the first sliding plate 20 together with the base 24 are attached to the inside surface 111 of the barrel cover 112. Care must be taken during the installation to assure that the fourth inclined surface 34 is parallel to and communicates freely with the third inclined surface 43 to prevent the jamming and binding of the movement of the second sliding plate 30. Next, the first end 51 of the guide shaft 50 is pulled away from the end surface 27 of the base section 24, that is in a direction opposite the preferred direction, for compressing the springs 76 and providing access to the shaft aperture 54 therein. Next, the shaft 72 is inserted within the aperture 54 for restraining the movement of the guide shaft 50 and the second sliding plate 30 coupled thereto. Next, the barrel cover 112 is coupled to its position over the barrel casing 110, thereby providing the proper planar communication between the sliding surfaces 21, 32, 34 and 43. After the barrel cover 112 has been securely attached, the shaft 72 is removed from within the aperture 54 thereby allowing the compression spring 76 to move the second sliding plate 30 in the preferred direction along the center line 38. As the centrifugal pump 100 is brought up to speed and the pressure accumulates along the first end 121 of the volute 120, the volute 120 will compress the annular sealing gasket 128.

As the distance between the first end surface 121 of the volute 120 and the inside surface 111 of the barrel cover 112 increases in response to the increase in pressure within the centrifugal pump 100, the second sliding plate 30 or wedge will move in the preferred direction along the center line 38, thereby increasing the separation between the outer surface 22 of the first sliding plate 20 and the outer surface 42 of the third sliding plate 40 to absorb the slack. The movement of the wedge or second sliding plate 30 will be actuated by the energy stored within the biasing or compression springs 76. When the output pressure of the contrifugal pump 100 is decreased, the volute 120 will tend to move toward the barrel cover 112, thereby removing some of the compression from the annular sealing gasket 128. However, presence of the self-adjusting spacer 10 will prevent this movement, since the mechanical advantage gained from the small angles included between the inclined surfaces and the direction of motion of the volute will allow the forces exerted by the volute on the self-adjusting spacer 10 to be reduced by a large factor. For example, if an angle of two degrees is defined between the first inclined surface 21 and the inside surface 111 of the barrel cover 112 (or the center line 38 of the second sliding plate 30), then the forces exerted on the guide shaft 50 will be reduced by a factor of approximately 28 as compared to the compression forces exerted on the outside surfaces of the self-adjusting spacer 10. Furthermore, these forces exerted upon the self-adjusting spacer 10 generally arise only from the resilient force of the annular sealing gasket 128 as the operational compression forces are removed from the first end 121 of the volute 120.

It is envisioned that at least four of the self-adjusting spacers 10 will be equally spaced about the impeller shaft 30 to absorb the spacing created between the barrel cover 112 and the volute 120 caused by the operation of the centrifugal pump 100. However, it is within the scope of this invention to build the inclined surfaces 21, 32, 34 and 43 directly into the respective elements of the pump 100 so as to alleviate the need for adding the separate unit at a later time.

Thus, a first preferred embodiment in accordance with the present invention has been illustrated as an example of the invention as claimed. However, the present invention should not be limited in its application to the details illustrated in the accompanying drawings and the specification, since this invention may be practiced or constructed in a variety of different embodiments. Also, it must be understood that the terminology and descriptions employed herein are used solely for the purpose of describing the general operation of the preferred embodiment and therefore should not be construed as limitations on the operability of the invention.

I claim:

1. A self-adjusting spacer for use in a centrifugal pump of the type having a volute movable axially within a barrel and covered by an end barrel cover, said self-adjusting spacer comprising in combination:

a first sliding plate having an outer surface coupled with an inside surface of the barrel cover, with said first sliding plate having a first inclined surface thereon;

a second sliding plate having an outer surface coupled with an inner surface of the volute, with said second sliding plate further having a second inclined surface thereon generally parallel to and in sliding communication with said first inclined surface of said first sliding plate; and bias means coupled between said first and second sliding plates for advancing the sliding communication therebetween in a preferred direction for increasing the separation between said outer surfaces of said first and second sliding plates, whereby any increase in the separation between the volute and the barrel cover will be absorbed by the effective combined width between said outer surfaces of said first and second sliding plates.

2. The self-adjusting spacer as described in claim 1 further comprising clutch means coupled between said first and second sliding paltes for preventing motion therebetween in a direction opposite said preferred direction.

3. The self-adjusting spacer as described in claim 2 wherein said clutch means comprises in combination:

a guide movably coupled between first and second sliding plates for regulating the relative motion therebetween; and unidirectional cam means engaging said guide for allowing movement between said first and second plates only in said preferred direction.

4. The self-adjusting spacer as described in claim 3, wherein said unidirectional cam means comprises in combination:

paired cams having parallel axes of rotation which are generally perpendicular to said preferred direction and spaced on opposite sides of said guide, with a separation between said cam axes being slightly smaller than the sum of the effective width of said guide and the effective length of a longitudinal lobe of each of said paired cams; and cam biasing means for biasing said longitudinal lobes of said paired cams into communication with said guide in a direction opposite said preferred direction.

5. The self-adjusting spacer as described in claim 2 further comprising enabling means coupled between said first and said second sliding plates for restricting the motion therebetween when in a guard mode.

6. The self-adjusting spacer as described in claim 5 wherein said enabling means comprises a pin coupled between said first and said second sliding plates for restricting the relative motion therebetween.

7. The self-adjusting spacer as described in claim 5 further comprising trigger means coupled to said enabling means for transitioning said enabling means from said guard mode to a free mode characterized by enabling of the relative motion between said first and said second sliding plates.

8. The self-adjusting spacer as described in claim 5 further comprising in combination:

a third sliding plate having an outer surface coupled with the end surface of said volute, with said third sliding plate including a third inclined surface thereon; and wherein said outer surface of said second sliding plate comprises a fourth inclined surface generally parallel with and in sliding communication with said third inclined surface of said third sliding plate, whereby any increase in the separation between the inside surface of the barrel cover and the end surface of the volute will be absorbed by the increased effective separation between said outer surfaces of said first and third sliding plates.

9. The self-adjusting spacer as described in claim 8 wherein said second and fourth inclined surfaces on said second sliding plate define a wedge for moving longitudinally along said preferred direction into a V-shaped void defined between said first and third inclined surfaces.

10. The self-adjusting spacer as described in claim 9 wherein said first, second, third and fourth inclined surfaces are generally planar.

11. The self-adjusting spacer as described in claim 10 wherein each of said first, second, third and fourth inclined surfaces intersect said preferred direction at an acute angle.

12. The self-adjusting spacer as described in claim 10 wherein said preferred direction is generally perpendicular to the direction of change in separation between the inside surface of the barrel cover and the end surface of the volute.

13. The self-adjusting spacer as described in claim 10 further comprising movable coupling means juxtaposed between said outer surface of said second sliding plate and the end surface of said volute for movably positioning said third inclined surface generally parallel to said fourth inclined surface, whereby any non-parallel aberrations between the inside surface of the barrel cover and the end surface of the volute may be compensated for.

14. The self-adjusting spacer as described in claim 13 wherein said movable coupling means comprises a concave recess in the end surface of the volute for movably coupling congruently with a convex protrusion on said outer surface of said third sliding plate.

* * * * *